US007789279B2

(12) United States Patent
Tan

(10) Patent No.: US 7,789,279 B2
(45) Date of Patent: Sep. 7, 2010

(54) GOLF BAG SUPPLEMENTARY ARRANGEMENT

(76) Inventor: Fu-Hsing Tan, 4th Fl., 101-1, Chi Lin Road, Yang Chou Tsun, Lu Chu, Taoyuan Hsien (TW)

( * ) Notice: Subject to any disclaimer, the term of this patent is extended or adjusted under 35 U.S.C. 154(b) by 25 days.

(21) Appl. No.: 12/209,576

(22) Filed: Sep. 12, 2008

(65) Prior Publication Data

US 2010/0065693 A1 Mar. 18, 2010

(51) Int. Cl.
*A45F 5/00* (2006.01)

(52) U.S. Cl. ..... 224/269; 224/257; 224/258; 224/271; 248/96

(58) Field of Classification Search ..... 224/257, 224/258, 262, 269, 271, 633, 637, 628; 248/96
See application file for complete search history.

(56) References Cited

U.S. PATENT DOCUMENTS 3,547,458 A * 12/1970 Price ..... 280/47.34
3,899,109 A * 8/1975 Noice ..... 224/262
4,194,656 A * 3/1980 Zufich ..... 224/631
4,303,186 A * 12/1981 Ollinger, IV ..... 224/634
6,041,444 A * 3/2000 McKinney ..... 2/310
6,199,732 B1 * 3/2001 Swetish ..... 224/262
6,840,419 B2 * 1/2005 Penny et al. ..... 224/637
6,886,727 B2 * 5/2005 Moore ..... 224/637
7,232,049 B2 * 6/2007 Meyer ..... 224/637
2004/0262357 A1 * 12/2004 Meyer ..... 224/628

* cited by examiner

*Primary Examiner*—Amy J Sterling

(57) ABSTRACT

A golf bag supplementary arrangement includes a base frame affixed to the periphery of a golf bag and having two horizontal lugs arranged in parallel, and a retaining bar pivotally connected between the two horizontal lugs of the base frame and adapted for attaching to a part of the body of the person carrying the golf bag to prohibit vibration of the golf bag when the person carrying the golf bag is walking.

5 Claims, 5 Drawing Sheets

GOLF BAG SUPPLEMENTARY ARRANGEMENT

BACKGROUND OF THE INVENTION

1. Field of the Invention

The present invention relates to a golf bag for carrying golf clubs and more particularly, to a golf bag supplementary arrangement that secures the golf bag to the user's body steadily when the user is carrying the golf bag on the shoulder.

2. Description of the Related Art

When playing a golf game, a player usually uses a golf bag to carry golf clubs. When a player is carrying a full set of golf clubs in a golf bag and walking on the golf course, the golf bag may oscillate, causing the shoulder strap to rub against the player's shoulder and back. Frequently rubbing of the shoulder strap against the shoulder and back may result injuries in the shoulder and the back. Further, a golf course has an uneven ground. When the upper part of the body inclines 20° forward, the pressure on the lumbar spine can be as high as twice the body weight, to say nothing of the pressure with the golf bag. Further, oscillation of a golf bag will add a vibration inertia force to the person carrying the golf bag when the person carrying the golf bag is walking, causing greater injuries.

Therefore, it is desirable to provide a measure that prevents oscillation of the golf bag during walking the player carrying the golf bag.

SUMMARY OF THE INVENTION

The present invention has been accomplished under the circumstances in view. It is one object of the present invention to provide a golf bag supplementary arrangement, which effectively prohibits vibration of the golf bag when the player carrying the golf bag is walking, avoiding injury.

To achieve this and other objects of the present invention, the golf bag supplementary arrangement comprises a base frame affixed to the periphery of a golf bag and having two horizontal lugs arranged in parallel, and a retaining bar pivotally connected between the two horizontal lugs of the base frame and adapted for attaching to a part of the body of the person carrying the golf bag to prohibit vibration of the golf bag when the person carrying the golf bag is walking.

DETAILED DESCRIPTION OF THE PREFERRED EMBODIMENT

Figure 1:
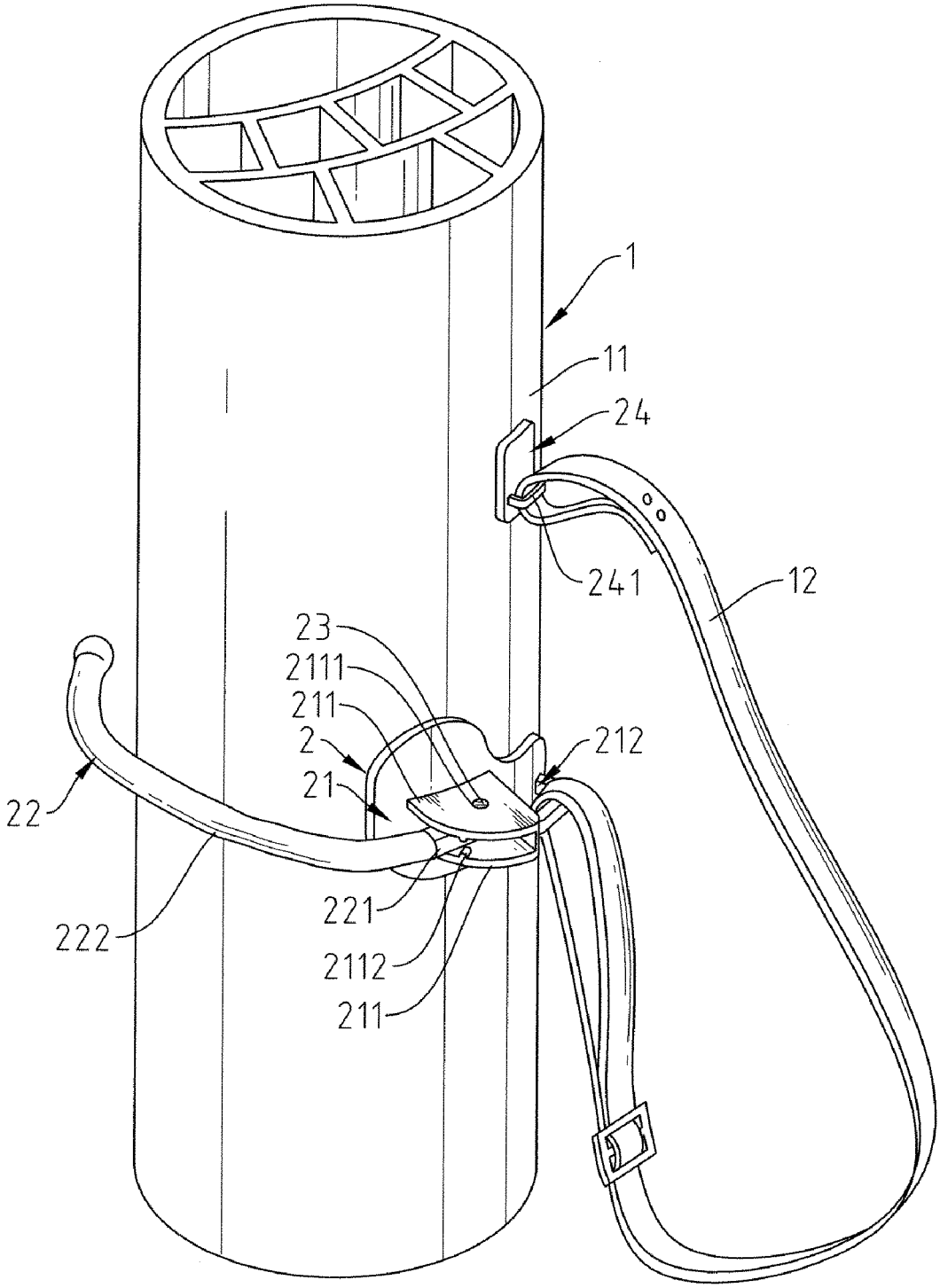
FIG. 1 is an elevational view of a golf bag constructed according to the present invention.
Figure 2:
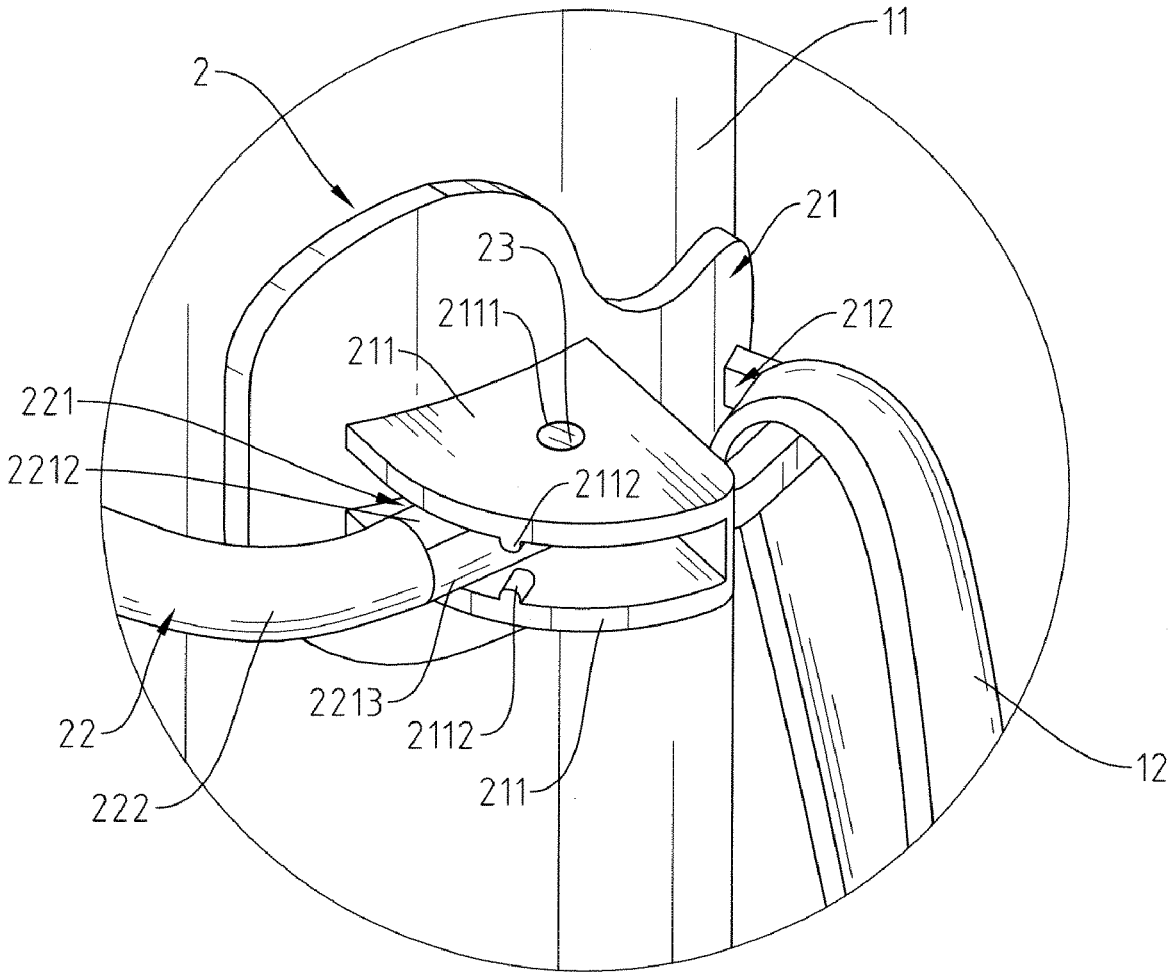
FIG. 2 is an enlarged view of a part of FIG. 1.
Figure 3:
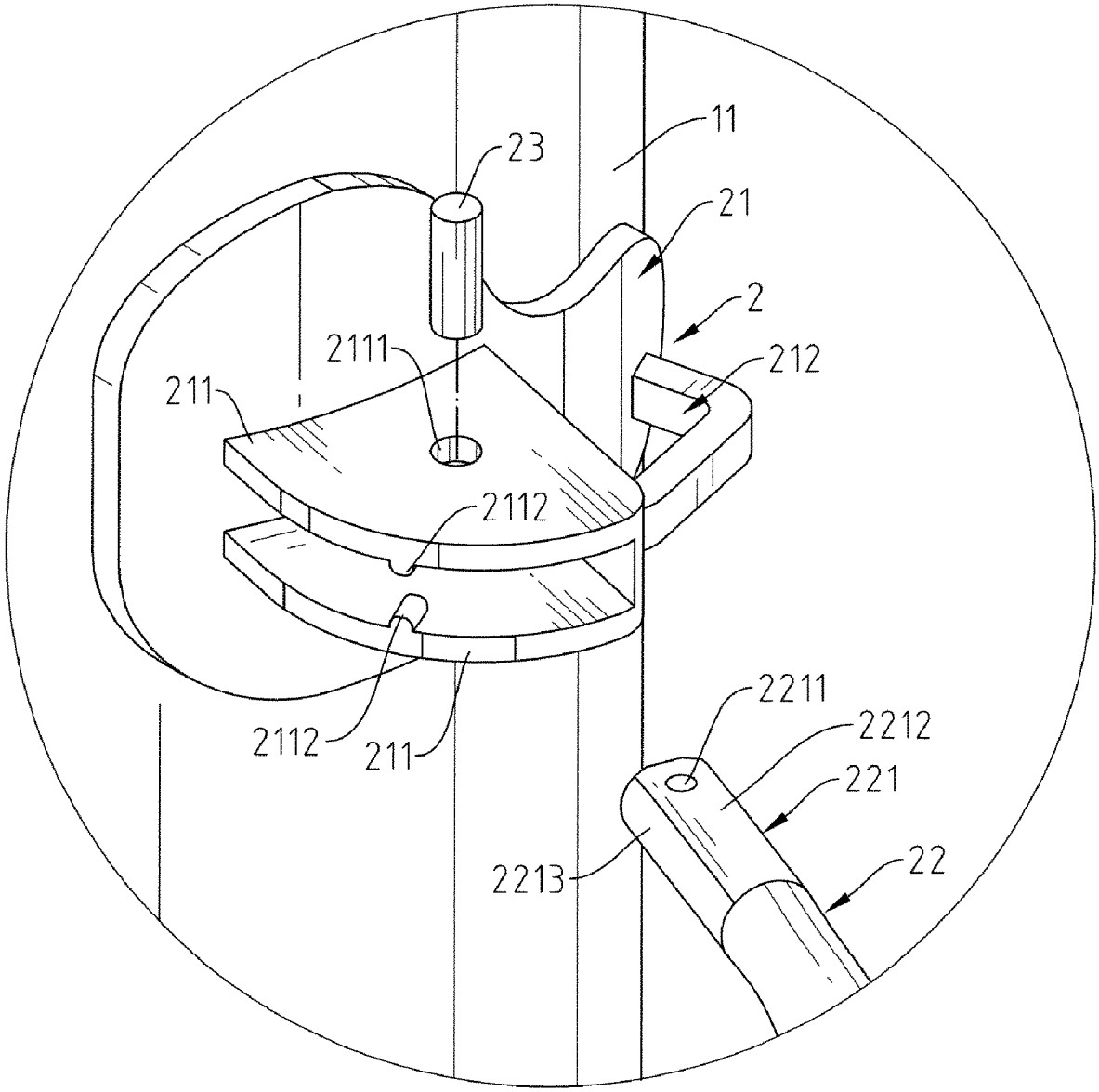
FIG. 3 is an exploded view of the supplementary device shown in FIG. 2.

Referring to FIGS. 1~3, a golf bag 1 is shown comprising a golf bag body 11 for carrying clubs during play, a shoulder strap 12 fastened to periphery of the golf bag body 11 for a person to carry the golf bag on the shoulder conveniently, and a supplementary device 2 provided at the periphery of the golf bag body 11. The supplementary device 2 comprises a base frame 21, a retaining bar 22, a connection device 23, and a locating member 24.

The base frame 21 is fixedly fastened to the lower part of the periphery of the golf bag body 11 at a suitable location, having two horizontal lugs 211 perpendicularly extended from the outer wall thereof arranged at different elevations in a parallel manner, two through holes 2111 respectively vertically cut through the horizontal lugs 211 and aligned in line, two protrusions 2112 respectively raised from the bottom wall of the upper horizontal lug 211 and the top wall of the lower horizontal lug 211 in a symmetric manner, and a strap mounting hole 212 disposed at one lateral side relative to the horizontal lugs 211 for the mounting of one end of the shoulder strap 12.

The retaining bar 22 comprises a smoothly curved retaining portion 222, and a connection end 221 extending from one end of the smoothly curved retaining portion 222 and insertable into the space between the two horizontal lugs 211 of the base frame 21. The connection end 221 has flat top and bottom sides 2212, a pivot hole 2211 cut through the flat top and bottom sides 2212 corresponding to the through holes 2111 on the horizontal lugs 211 of the base frame 21, and two smoothly arched lateral sides 2213 bilaterally connected between the flat top and bottom sides 2212.

The connection device 23 is a pivot pin inserted through the through holes 2111 and the pivot hole 2211 to pivotally secure the connection end 221 of the retaining bar 22 to the base frame 21.

The locating member 24 is fixedly mounted on the periphery of the golf bag body 11 above the base frame 21, having a mounting portion 241 for the mounting of one end of the shoulder strap 12.

Figure 4:
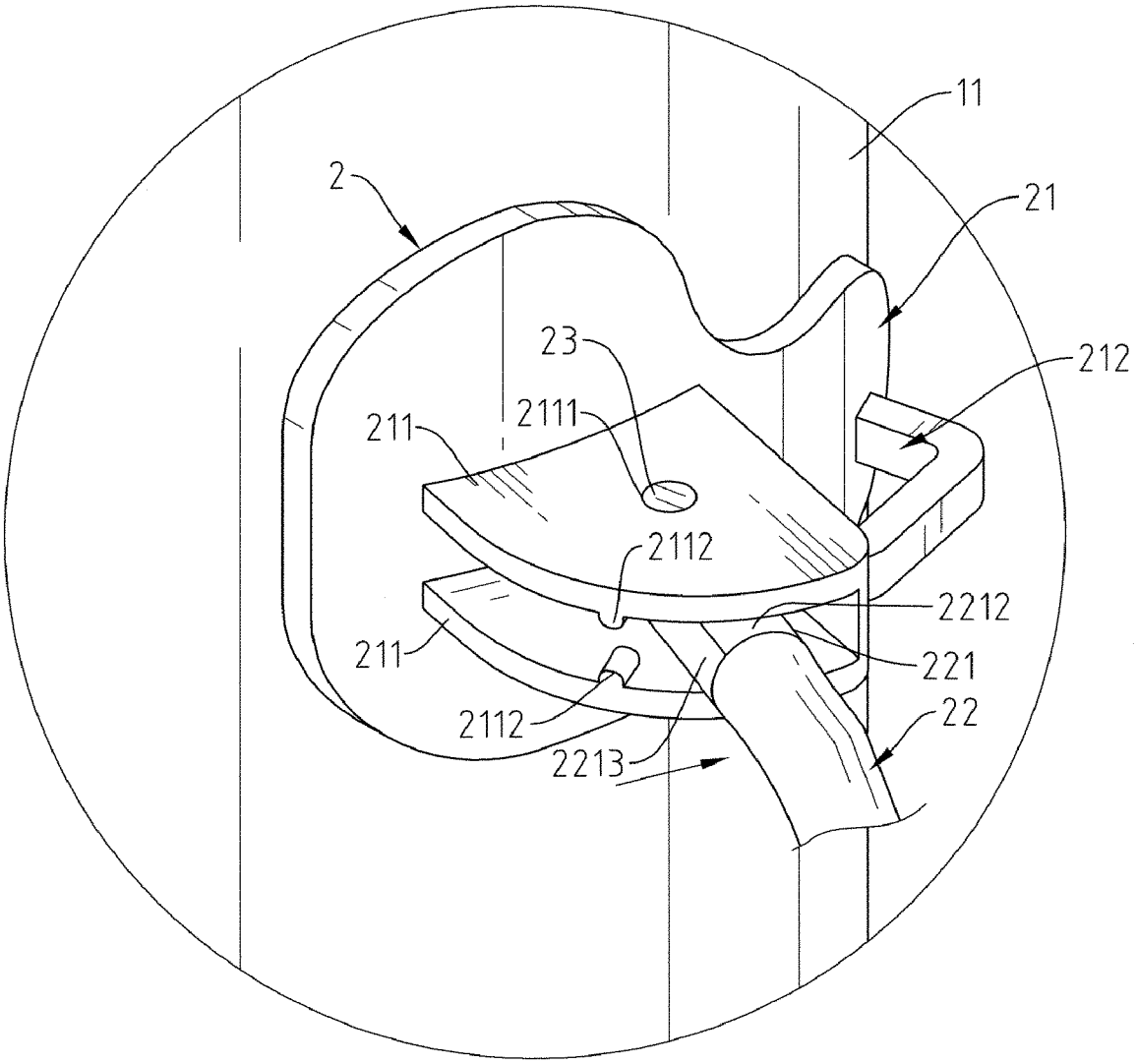
FIG. 4 is an elevational assembly view of FIG. 3.
Figure 5:
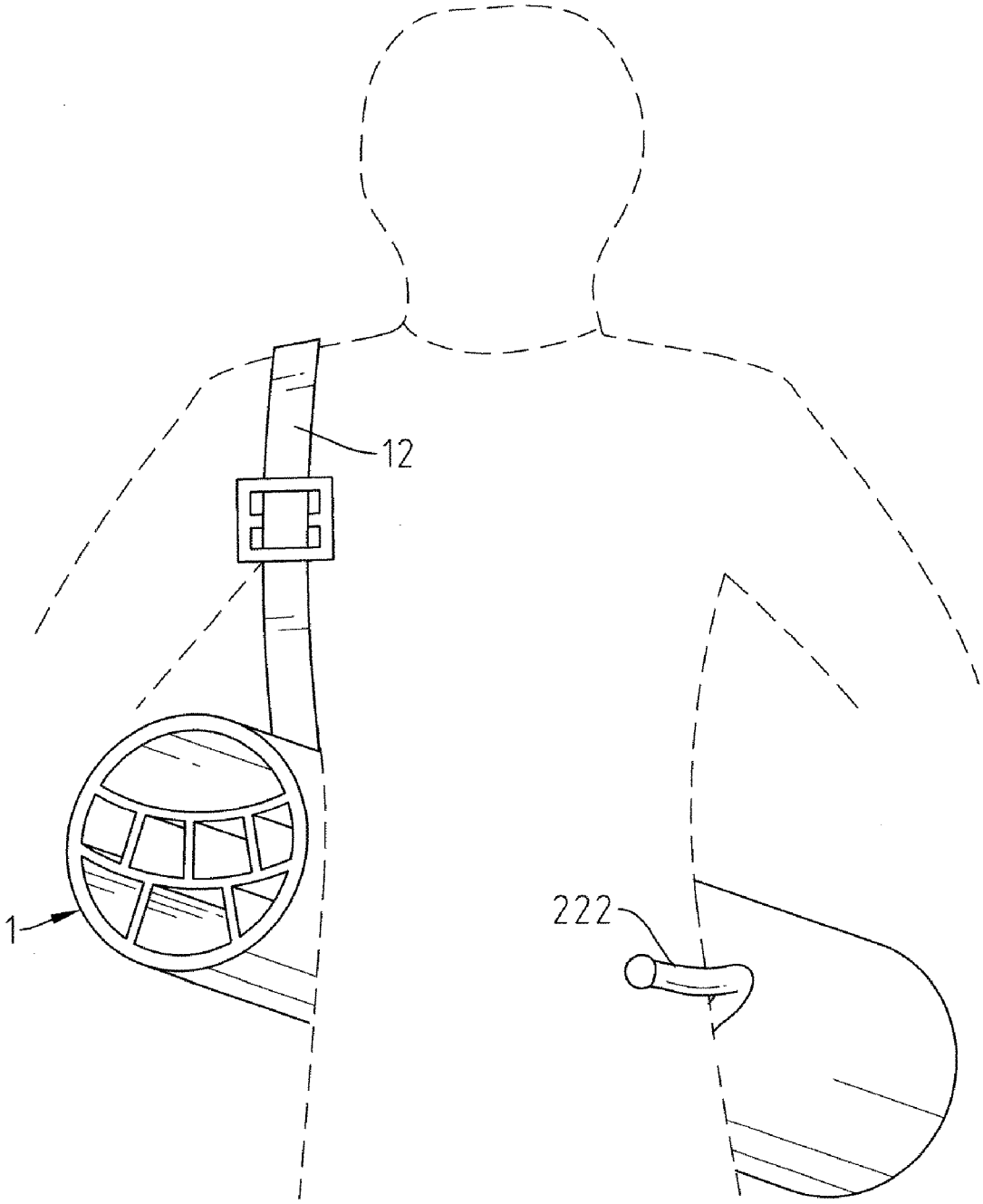
FIG. 5 is a schematic drawing showing an application example of the present invention.

Referring to FIGS. 4 and 5, when in use, the user turns the retaining bar 22 outwards from the golf bag body 11. When turning the retaining bar 22, the smoothly arched lateral sides 2213 will be forced to move over the protrusions 2112. Further, the distance between the protrusions 2112 of the horizontal lugs 211 is not greater than the distance between the flat top and bottom sides 2212 of the connection end 221 of the retaining bar 22.

At this time, the user can put the shoulder strap 12 on the shoulder to carry the golf bag on the back, and then attach the smoothly curved retaining portion 222 of the retaining bar 22 to the front side of the user's body, and therefore the golf bag does not oscillate when the user is walking.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A golf bag supplementary arrangement, comprising a golf bag for carrying golf clubs, a shoulder strap fastened to said golf bag for carrying by a person, and a supplementary device fastened to said golf bag for securing said golf bag to the body of a person carrying said golf bag, wherein said supplementary device comprises:

a base frame affixed to the periphery of said golf bag, said base frame comprising two horizontal lugs perpendicularly extending from an outer wall thereof and arranged in parallel at different elevations; and a retaining bar, said retaining bar comprising a connection end pivotally connected between said horizontal lugs, and a smoothly curved retaining portion extending from said connection end and attachable to a part of the body of the person carrying said golf bag to prohibit vibration of said golf bag when the person carrying said golf bag is walking;

wherein said horizontal lugs each have a protrusion facing each other, and a distance between the protrusions of said horizontal lugs is not greater than a distance between a flat top wall and a flat bottom wall of said connection end of said retaining bar.

2. The golf bag supplementary arrangement as claimed in claim 1, wherein said connection end has a pivot hole cut through top and bottom sides thereof; said horizontal lugs each have a through hole; the golf bag supplementary arrangement further comprises a pivot pin mounted in the through holes on said horizontal lugs and inserted through the pivot hole of said connection end to pivotally secure said retaining bar to said horizontal lugs.

3. The golf bag supplementary arrangement as claimed in claim 1, wherein said connection end of said retaining bar comprises the flat top wall and the flat bottom wall respectively disposed at the top and bottom sides thereof, and two smoothly arched lateral walls bilaterally connected between said flat top wall and said flat bottom wall.

4. The golf bag supplementary arrangement as claimed in claim 1, wherein said base frame comprises a strap mounting hole disposed at one lateral side relative to said horizontal lugs for the mounting of one end of said shoulder strap.

5. The golf bag supplementary arrangement as claimed in claim 1, further comprising a locating member affixed to the periphery of said golf bag above the elevation of said base frame, said locating member comprising a mounting portion for the mounting of one end of said shoulder strap.

* * * * *